United States Patent [19]

Otto

[11] 4,121,900

[45] Oct. 24, 1978

[54] METHOD FOR MODIFYING FIBERS OF A FABRIC BY ELECTROLYSIS AND THE PRODUCTS SO PRODUCED

[75] Inventor: Wolfgang K. F. Otto, Spartanburg, S.C.

[73] Assignee: Milliken Research Corporation, Spartanburg, S.C.

[21] Appl. No.: 799,619

[22] Filed: May 23, 1977

[51] Int. Cl.[2] ..... D06Q 1/02; C25B 1/14

[52] U.S. Cl. ..... 8/115; 8/2; 8/125; 8/DIG. 12; 204/98; 204/103; 204/104; 204/132; 204/181 F

[58] Field of Search ..... 8/2, DIG. 12, 115, 125; 204/181 F, 98, 103, 104, 132, 181 F

[56] References Cited

U.S. PATENT DOCUMENTS

| | | | |
|---|---|---|---|
| 1,309,214 | 7/1919 | Moore | 204/295 |
| 1,972,608 | 9/1934 | Uhlmann | 8/DIG. 12 |
| 2,371,145 | 3/1945 | Brubaker | 8/2 |
| 2,954,333 | 9/1960 | Heiskell et al. | 204/98 |

FOREIGN PATENT DOCUMENTS

| | | | |
|---|---|---|---|
| 221,980 | 9/1924 | United Kingdom | 204/132 |

*Primary Examiner*—A. Lionel Clingman

*Attorney, Agent, or Firm*—Glen M. Burdick; H. William Petry

[57] ABSTRACT

A method for modifying fibers of a fabric which comprises applying an effective amount of an aqueous salt solution to the fabric to sufficiently wet all of the fibers of the fabric with the salt solution, removing excess solution from the fabric, contacting the wetted fabric with a pair of electrodes through which a sufficient electromotoric force is aplied to the salt solution in the fabric to generate an acidic and/or caustic solution at or near the surface of the fabric. Thereafter, the fabric is heated for a period of time and at a temperature effective to produce a chemical reaction between the fibers wet with the acidic and/or caustic constituent resulting from the above electrolysis of the aqueous salt solution. After the desired degree of fiber modification has occurred, the chemical reaction is quenched and the resulting product recovered. The particular salt constituent employed in the aqueous salt solution will be dependent upon whether the desired fiber modifying agent is an acid, base, or both.

12 Claims, No Drawings

METHOD FOR MODIFYING FIBERS OF A FABRIC BY ELECTROLYSIS AND THE PRODUCTS SO PRODUCED

The present invention relates to a method for modifying the fibers of a fabric. In one aspect, it relates to a method for modifying fibers of a fabric wherein the fiber modification is controlled. In another aspect the invention relates to a method for modifying fibers of a fabric wherein the fiber modifying agent, a heat activated fiber modifying agent, is produced in situ within the fabric by the use of electrolysis. In yet another aspect the present invention relates to products produced by the method of the present invention.

Methods have heretofore been proposed for modifying fibers of fabrics, such as polyester fibers, so as to improve certain properties of the fabrics or to alter their appearance. Numerous chemical and physical means have been employed to accomplish such fiber modification. For example, a large variety of chemicals, such as depolymerizing agents, have been incorporated into fabrics so that a depolymerization reaction could occur thus altering the fiber characteristics of the fabric. Additionally, methods have been proposed to heat dry fabrics to alter the fiber characteristics of such fabrics. However, when employing the methods proposed by the prior art, problems have been encountered if one attempts to efficiently and effectively confine the area of treatment of a fabric to a predetermined surface, or area, without modifying the fibers of the fabric completely throughout same. Thus, a need has long been recognized for an improved method which would allow one to effectively and efficiently modifiy certain fibers of a fabric without affecting other fibers and thereby produce a fabric having desired characteristics or appearance.

An object of the invention is to provide an improved process for modifying fibers of a fabric. Another object of the invention is to provide an improved fabric in which a preselected portion of the fibers of the fabric have been modified. These and other objects, advantages and features of the invention will be apparent to those skilled in the art from a reading of this disclosure.

Broadly, the present invention relates to improved products and to methods for producing same wherein selected fibers on or near at least one surface of a fabric are modified without modification of the remaining fibers of the fabric. The controlled modification of the fibers of the fabric is achieved by first applying an effective amount of an aqueous salt solution to a fabric to sufficiently wet all of the fibers of the fabric. The excess solution is removed from the fabric and the resulting wetted fabric is contacted with a pair of electrodes through which sufficient electromotoric force is applied to the salt solution in the fabric to generate an acidic and/or caustic constituent on the appropriate surface of the fabric in contact with the electrodes. The fabric, containing the acidic and/or caustic constituent, is then heated for a period of time and at a temperature effective to produce a chemical reaction between the fibers of the fabric wet with the acidic and/or caustic constituent resulting from the before-mentioned electrolysis of the aqueous salt solution. After the desired fiber modification has occurred the chemical reaction is quenched and the product recovered.

In one embodiment, wherein fiber modification is to be confined to or near one surface of the fabric and such fiber modification is to be accomplished due to a heat activated chemical reaction between a caustic constituent and the fibers of the fabric, the aqueous salt solution contains as the salt constituent, a water-soluble salt in which the cation moiety of the salt is $Na^+$ or $K^+$ and the anion moiety is $CO_3^{--}$, $HCO_3^-$ or an organic anion of an organic acid having a pk value of from about 3 to about 5.

When fiber modification is to be confined to or near one surface of the fabric and such fiber modification is to be accomplished by the heat activated chemical reaction between an acidic constituent and the fibers of the fabric such can readily be accomplished by using an aqueous salt solution in which the salt constituent is a water-soluble salt having as its cation $Mg^{++}$, $Al^{+++}$ or $NH_4^+$ and as its anion $SO_4^{--}$ and $PO_4^{---}$. However, when it is deemed desirable to modify a portion of the fibers in or near two opposing surfaces of the fabric the salt constituent of the aqueous salt solution is a water-soluble salt having as the cation $Na^+$ or $K^+$ and as the anion $SO_4^{--}$ or $PO_4^{---}$.

It is to be understood, that if desirable, other normal processing steps in the manufacturing process of fabrics can be employed without altering the method of modification of select fibers of a fabric. For example, after the fiber modification has occurred due to the heat activated chemical reaction between the preselected fibers of the fabric and the generated acidic or caustic constituent, and the reaction has been quenched, the resulting fabric can be napped, dyed, and the like. Such fabric processing procedures are well known to those skilled in the art.

Any suitable fabric formed of fibers which are capable of reacting with an acidic and/or caustic constituent, upon application of heat, to provide a chemical and/or physical change in the fibers can be employed in the practice of the present invention. Thus suitable fabrics can be formed of natural and/or synthetic fibers. Examples of fabrics which can be employed are those containing fibers of polyesters, nylon, acetate, Kevlar, wool, cotton, linen, silk, acrylic and mixtures of such fibers. Especially desirable results can be obtained when the fabric is one formed of polyester fibers and blends of polyester and cotton fibers. Once the fabric substrate has been selected and it is determined that it is desirable to modify preselected fibers of the fabric, the fabric is wetted with an aqueous salt solution containing the desired water-soluble salt constituent.

Many methods can be employed to apply the aqueous salt solution to the fabric substrate. For example, the fabric substrate can be padded with the aqueous salt solution and thereafter nipped to remove excess liquid from the wetted fabric. The aqueous salt solution could also be sprayed onto the fabric. However, regardless of the method employed for applying the aqueous salt solution to the fabric substrate two essential criteria must be met, namely, all of the fibers of the fabric must be sufficiently wet with the aqueous salt solution and excess solution should be removed.

The amount of the salt constituent present in the aqueous salt solution can vary widely but will generally be present in an amount of from about 0.1 to 25 weight percent. Especially desirable results can be obtained when the salt constituent is present in the aqueous salt solution in an amount of from about 1 to about 15 weight percent. Further, the aqueous salt solution can contain a single salt on a combination of salt constituents.

The choice of the particular water-soluble salt constituent employed in the aqueous solution of the present invention will be dependent upon one's desire to modify a predetermined surface or both surface of the fabric due to the in situ formation of an acidic and/or caustic constituent by electrolysis of the aqueous salt solution and the subsequent application of heat to the fabric having fibers wet with the acidic and/or caustic constituent. For example, when one desires to achieve surface modification on or near the surface of the fabric by heat activating a chemical reaction between a caustic constituent generated in situ by electrolysis of the aqueous salt solution and the fibers of the fabric wet with such caustic constituent the water-soluble salt employed in the aqueous salt solution can be sodium carbonate, sodium bicarbonate, potassium carbonate, potassium bicarbonate, sodium acetate, sodium formate, sodium citrate, potassium acetate, potassium formate, potassium citrate, and the like. Such salts, in addition to being water-soluble contain anion and cation moieties meeting the criteria for such moieties previously set forth. When one desires to achieve surface modification on or near the surface of the fabric by heat activating a chemical reaction between an acidic constituent generated in situ by electrolysis of the aqueous salt solution and the fibers of the fabric wet with the acidic constituent, the salt, in addition to being water-soluble, should contain, as its cation, $Mg^{++}$, $Al^{+++}$ or $NH_4^+$ and as its anion $SO_4^{--}$ or $PO_4^{---}$ as previously described. Typical of such salts are magnesium sulfate, magnesium phospate, aluminum sulfate, ammonium sulfate and ammonium phosphate.

However, when it is deemed desirable to generate, in situ, by electrolysis of an aqueous salt solution a caustic constituent on or near the surface of the fabric in contact with the cathode which, when heated produces a chemical reaction between the caustic constituent and the fibers wet with same, and an acidic constituent on or near the surface of the fabric in contact with the anode which also, upon heating, produces a chemical reaction between the acidic constituent and the fibers wet with same, the salt employed in the aqueous solution, in addition to being water-soluble, contains sodium or potassium cations and sulfate or phosphate anions. Typical examples of such salts are sodium sulfate, sodium phosphate, potassium sulfate and potassium phosphate.

The electrodes employed in the present invention can vary widely in nature and structure, provided however, such electrodes should be formed of a metal substantially inert to the acidic and caustic aqueous solution generated within the fabric by the electrolysis of the aqueous salt solution and which are further resistant to corrosion. Further, it is important that the electrodes be formed of a suitable size to contact the wet fabric in the areas where fiber modification in the fabric is desired. Thus, while the nature of the electrodes, as well as the size and configuration of same can vary widely, especially desirable results can be obtained when the electrodes are fabricated from platinum, stainless steel and the like and the electrodes are of sufficient size to extend across the entire width of the fabric.

The amount of electromotoric force applied to the electrodes in contact with opposite surfaces of the wet fabric to generate the desired acidic and/or caustic solution by electrolysis of the aqueous salt solutions can vary widely, as can the time required for the effective electrolysis of the salt solution. Generally, however, the electromotoric force applied to the electrodes will be from about 10 to about 200 volts for a period of time from about 1 second to about 60 seconds.

Once the fabric has been wet with the aqueous salt solution and the electrolysis of the salt solution has occurred to produce the appropriate acidic and caustic solutions, the fabric, now containing fibers wet with such acidic and caustic solutions is heated to a temperature sufficient to initiate a chemical reaction between the fibers of the fabric and the acidic constituent, the caustic constituent, or both, such being determined by the initial selection of the salt constituent of the aqueous salt solution as previously described. The temperature to which the fabric is heated can vary widely, as can the time period for such heating, provided the fabric is heated for an effective period of time at a temperature necessary to effectively and efficiently activate the reaction between acidic and/or caustic constituent and the fibers of the fabric wet with such constituents. However, care must be exercised to insure that the heating temperature does not reach the melting temperature of the fibers of the fabric. Generally, the desired reaction between the acidic and/or caustic constituents and the fiber of the fabric wet with same will readily occur when the fabric is heated at a temperature of from about 150° F. to about 425° F. for a period of time of from about 0.1 second to about 60 seconds.

Any suitable heating means can be employed as the heat source to heat the treated fabric and thus initiate the chemical reaction between the acidic and/or caustic constituent and the fibers of the fabric wet with same. For example, such heating can be accomplished using an oven, dryer, contact heating means, convection heating means, radiant heating means, electric current, or an open flame. The particular heating means chosen will be dependent primarily upon the processing equipment available to the fabric processor.

It may be desirable to increase the viscosity of the aqueous salt solution. Such can be accomplished by incorporating an effective amount of a thickening agent into the aqueous salt solution. However, the thickening agent employed must be substantially inert to the salt solution and the fabric while not interfering with the desired electrolysis of the aqueous salt solution. Such thickening agents are well known in the art. However, for illustrative purposes, typical thickening agents which can be employed in the aqueous salt solution in accordance with the present invention are guar gum, polyaccarides, silicates and the like.

After the desired fiber modification has occurred due to the combination of the in situ generated acidic and/or caustic constituent and the application of heat to the thus treated fabric, the resulting modified fabric is quenched to prevent further fiber modification and to remove residual acidic and caustic constituents. Any suitable quenching process can be employed. However, especially desirable results can be obtained when the modified fabric is quenched with water or an aqueous admixture containing at least one deactivating agent which will neutralize and inactivate any acidic or caustic constituents remaining in the fabric. After quenching, the modified fabric can be washed, dried and, if desired, subjected to other textile or fabric processing conditions such as steaming, dyeing, napping, sanding and the like.

In order to illustrate further the details of the method of the present invention, the following specific example is given. The example is presented primarily for the purpose of illustration and any enumeration or details contained therein are not to be interpreted as a limitation of the invention except as indicated in the appended claims. All weights referred to in the example are parts by weight unless otherwise indicated.

EXAMPLE I

A swatch of a texturized polyester double knit fabric was padded with an aqueous solution containing 10 weight percent sodium acetate. Excess liquid was then removed from the wet fabric by nipping same at 60 psi. The wet fabric was then placed between two stainless steel electrodes and an electromotoric force of 60 volts was applied to the fabric for a period of 30 seconds. The swatch was then removed and positioned on a hot plate so that the side portion of the swatch which had been in contact with the cathode, e.g., the side of the fabric containing the generated NaOH on its surface, was in direct contact with the heated surface of the hot place which had a temperature of 385° F. Heat from the hot plate was applied to the fabric swatch for 15 seconds. The sample was then removed from the hot plate and washed with chilled water. The washed fabric swatch was then dyed using a basic dyestuff, Basic Blue 54, to determine if fiber modification had occurred in fabric swatch. The side portion of the fabric swatch which had been in contact with the cathode was more heavily stained with the basic dyestuff than was the side of the fabric swatch contacted with the anode. Such differential in color acceptance of the basic dyestuff by the fabric is indicative of fiber modification on the surface of the fabric in contact with the cathode, e.g., the surface where the NaOH was generated.

A second swatch of a polyester double knit fabric similar to the one used above was padded with an aqueous solution containing 10 weight percent sodium acetate, nipped at 60 psi to remove excess solution and placed on a hot plate mantained at 385° F. for 15 seconds. The sample was then washed with chilled water and dyed with a basic dyestuff, Basic Blue 54, using the same procedure as above. Substantially, no staining of the fabric swatch was detected.

Thus, the above example clearly indicated modification of fiber within one surface of a polyester fabric using the concept of the present invention.

Having thus described the invention, I claim:

1. A method for modifying at least a portion of the fibers of one surface of a fabric which comprises:

a. applying an effective amount of an aqueous salt solution to the fabric to sufficiently wet all of the fibers of the fabric with said salt solution, said salt solution containing a water-soluble salt constituent in which the cation moiety of said salt constituent is selected from the group consisting of $Na^+$ and $K^+$ and the anion moiety of said salt constituent is selected from the group consisting of an organic anion of an organic acid having a pk value of from about 3 to about 5, $CO_3^{--}$ and $HCO_3^-$;

b. removing excess solution from the fabric to provide a resulting wet fabric;

c. contacting said wet fabric with a pair of electrodes, one of said electrodes, the cathode, contacting the surface of said wet fabric where fiber modification is desired and the other of said electrodes, the anode, contacting the surface of said wet fabric opposite the surface to be modified;

d. applying a sufficient D.C. electromotoric force to said pair of electrodes for a period of time of from about 1 second to about 60 seconds, said period of time being sufficient to generate an alkaline solution on the surface of said wet fabric in contact with said cathode and an acidic solution on the surface of said wet fabric in contact with said anode;

e. heating the fabric containing fibers wet with said alkaline solution for a period of time effective to produce a chemical reaction between said fibers wet with said alkaline solution and the alkaline constituent of said alkaline solution;

f. quenching the chemical reaction after the desired fiber modification has occurred; and g. recovering a resulting product.

2. The method of claim 1 wherein each of said electrodes extend across the entire width of said fabric and said D.C. electromotoric force of from about 10 volts to about 200 volts is applied to said electrodes.

3. The method of claim 2 wherein the fabric containing fibers wet with said alkali solution are heated to a temperature of from about 150° F. to about 425° F. for a period of time of from about 0.1 second to about 60 seconds.

4. The method of claim 3 wherein said chemical reaction is quenched by applying an effective amount of a diluted aqueous acid solution to the fabric to effectively neutralize substantially all of the alkaline constituent on said fibers of the fabric and further includes the steps of washing the resulting neutralized fabric with water to remove substantially all of the salt constituents present in the fabric and thereafter drying the washed fabric.

5. The method of claim 4 wherein said aqueous salt solution is sodium acetate and wherein said diluted acid solution to neutralize said alkaline constituent is acetic acid.

6. A method for modifying at least a portion of the fibers of one surface of a fabric which comprises:

a. applying an effective amount of an aqueous salt solution to the fabric to sufficiently wet all of the fibers of the fabric with said salt solution, said salt solution containing a water-soluble salt constituent in which the cation moiety of said salt constituent is selected from the group consisting of $Mg^{++}$ $NH^+_4$ and $Al^{+++}$ and the anion moiety of said salt solution is selected from the group consisting of $SO_4^{--}$ and $PO_4^{---}$;

b. removing excess solution from the fabric to provide a resulting wet fabric;

c. contacting said wetted fabric with a pair of electrodes, one of said electrodes, the anode, contacting the surface of said wet fabric where fiber modification is desired and the other of said electrodes, the cathode, contacting the surface of said wet fabric opposite the surface to be modified;

d. applying a sufficient D.C. electromotoric force to said pair of electrodes for a period of time of from about 1 second to about 60 seconds, said period of time being sufficient to generate an acidic solution on the surface of said wet fabric in contact with said anode;

e. heating the fabric containing fibers wet with said acidic solution for a period of time effective to produce chemical reaction between said fibers wet with said acidic solution and the acidic constituent of said acidic solution;

f. quenching the chemical reaction after the desired fiber modification has occurred;

g. recovering a resulting product.

7. The method of claim 6 wherein each of said electrodes extend across the entire width of said fabric and said D.C. electromotoric force of from about 10 volts to about 200 volts is applied to said electrodes.

8. The method of claim 7 wherein the fabric containing fibers wet with said acidic solution are heated to a temperature of from about 150° F. to about 425° F. for a period of time of from about 0.1 second to about 60 seconds.

9. The method of claim 8 wherein the chemical reaction between said acidic solution and the fibers wet with same is quenched by applying an effective amount of a diluted aqueous caustic solution to the fabric to effectively neutralize substantially all of the acidic constituent remaining on said fibers and which further includes the steps of washing the resulting neutralized fabric with water to remove substantially all of the salt constituents present in said fabric and thereafter drying the washed fabric.

10. A method for modifying at least a portion of the fibers of two opposing surfaces of a fabric which comprises:

a. applying an effective amount of an aqueous salt solution to the fabric to sufficiently wet all of the fibers of the fabric with said salt solution, said salt solution containing a water-soluble salt constituent in which the cation moiety of said salt constituent is selected from the group consisting of $Na^+$ and $K^+$ and the anion moiety of said salt solution is selected from the group consisting of $SO_4^{--}$ and $PO_4^{---}$;
b. removing excess solution from the fabric to provide a resulting wet fabric;
c. contacting said wet fabric with a pair of electrodes, one of said electrodes, contacting one surface of said wet fabric and the other of said electrodes, contacting the opposite surface of said wet fabric;
d. applying a sufficient D.C. electromotoric force to said pair of electrodes for a period of time of from about 1 second to about 60 seconds, said period of time being sufficient to generate an alkaline solution on the surface of said wet fabric in contact with the cathode of said electrodes and an acidic solution on the opposing surface of said wet fabric in contact with the anode of said electrodes;
e. heating the fabric for a period of time effective to produce a chemical reaction between said fibers wet with said alkaline solution and the alkaline constituent of said alkaline solution and a chemical reaction between said fiber wet with said acidic solution and the acid constituent of said acid solution;
f. quenching the chemical reaction after the desired fiber modification has occurred;
g. recovering a resulting product.

11. The method of claim 10 wherein each of said electrodes extend across the entire width of said fabric and said D.C. electromotoric force of from about 10 volts to about 200 volts is applied to said electrodes.

12. The method of claim 11 wherein the fabric containing fibers wet with said alkaline solution and said acidic solution are heated to a temperature of from about 150° F. to about 425° F. for a period of time of from about 0.1 second to about 60 seconds and further includes the steps of quenching the chemical reaction of said acidic solution with the fibers of the fabric and the chemical reaction of said alkaline solution with the fibers of the fabric with an effective amount of water, washing the resulting fabric with water, and thereafter drying the washed fabric.

* * * * *

UNITED STATES PATENT OFFICE

CERTIFICATE OF CORRECTION

Patent No. 4,121,900 Dated October 24, 1978

Inventor(s) Wolfgang K. F. Otto

It is certified that error appears in the above-identified patent and that said Letters Patent are hereby corrected as shown below:

In the Abstract, line 7, the word "aplied" should be --applied--.

Column 2, line 67, the word "on" should be --or--.

Column 3, line 4, the word "surface", second occurrence, should be -- surfaces --.

Column 5, line 18, the word "place" should be --plate--.

Column 5, line 24, after the word "in", insert the word --the--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*